United States Patent [19]

Minneman

[11] Patent Number: 4,666,038

[45] Date of Patent: May 19, 1987

[54] GOLD EQUIPMENT CARRIER

[76] Inventor: William J. Minneman, R.R. 1, Clayton, Ohio 45315

[21] Appl. No.: 835,715

[22] Filed: Mar. 3, 1986

[51] Int. Cl.[4] ..... A63B 55/00

[52] U.S. Cl. ..... 206/315.2; 211/198; 224/918

[58] Field of Search ..... 206/315.2; 224/270, 224/918; 211/198; 248/130, 284, 291

[56] References Cited

U.S. PATENT DOCUMENTS

| | | | |
|---|---|---|---|
| 1,554,211 | 9/1925 | Halevy | 211/198 |
| 2,070,254 | 2/1937 | Burgner | 150/1.5 |
| 2,415,314 | 2/1947 | Todd | 150/1.5 |
| 2,737,990 | 3/1956 | De Marco | 150/1.5 |
| 2,926,713 | 3/1960 | Vaughan | 150/1.5 |
| 2,987,109 | 6/1961 | Sohmer | 155/2 |
| 2,990,865 | 7/1961 | Steele | 150/1.5 |
| 3,215,181 | 11/1965 | Reed | 150/1.5 |
| 3,232,503 | 2/1966 | Thonen | 224/45 |
| 3,249,232 | 5/1966 | Pokorski | 211/198 |
| 4,036,416 | 7/1977 | Lowe | 224/45 R |
| 4,616,749 | 10/1986 | Briggs | 206/315.2 |

*Primary Examiner*—Joseph Man-Fu Moy
*Attorney, Agent, or Firm*—Biebel, French & Nauman

[57] ABSTRACT

A molded plastic gold equipment carrier includes a primary support frame and a secondary support frame hingedly connected thereto. Each of the support frames include golf club supporting legs which are interconnected by cross-members a selected distance above their distal ends which form ground engaging tips. The primary support frame includes a carrying handle also used to deploy the carrier to a stable opened position from a closed position. The legs of the secondary support frame extend beyond the legs of the primary support frame such that the secondary support frame may be engaged with the ground, and the primary support frame tilted outwardly from the secondary support frame by means of the handle to the opened position. Parallel projections on the first, second, third and fourth legs define upwardly open golf club retaining notches and support plastic golf retaining springs therein such that golf clubs may be supported in a generally horizontal orientation by pairs of the projections. Golf ball retaining arms on cross-members interconnecting the first and second legs and the third and fourth legs hold golf balls within apertures formed on the cross-members, while golf tees are supported within hollow segmented bosses opening to the outer surfaces of the cross-members and extending inwardy therefrom.

10 Claims, 5 Drawing Figures

GOLD EQUIPMENT CARRIER

BACKGROUND OF THE INVENTION

The present invention relates generally to golf, and more particularly, to a golf carrier for removably supporting a plurality of golf clubs and associated golfing equipment to facilitate carrying the clubs and equipment around a golf course.

Golf clubs and associated golfing equipment are typically carried in golf bags which are oftentimes cumbersome and heavy even when they contain no clubs or other equipment. Such golf bags may be slung over the shoulder of a golfer and carried about a course during a round of golf. Alternatives to personally carrying the bag include caddies, which are expensive and typically not available, or golf carts, which may be powered for also carrying the golfer or pulled by the golfer for only supporting the golf bag, clubs and associated equipment. Powered golf carts are also expensive and of limited availability, while individual golf carts only add to the weight and cumbersome nature of the golf bag.

In view of this apparent need, numerous devices which are significantly lighter in weight, less cumbersome and less expensive than conventional golf bags have been developed for holding golf clubs and oftentimes also associated golfing equipment. While these devices each present certain advantages and disadvantages, new alternative devices which offer the potential for lower cost, overcome certain deficiencies of the prior art and may be preferred by many golfers are in demand and serve to expand the options available to golfers who are looking for highly reliable lightweight and readily portable golf equipment carriers.

SUMMARY OF THE INVENTION

In accordance with the present invention, a golf carrier provides for removably supporting a plurality of golf clubs and golfing equipment on a primary support frame and a secondary support frame which is hingedly mounted to the primary support frame. The primary support frame includes golf club supporting first and second legs which are interconnected at their upper ends by a first cross-member and at a defined distance above their lower ends by a second cross-member. The lower ends of the first and second legs terminate in ground engaging tips, and the first cross-member defines handle means which preferably comprises a bridged section extending over and above the first cross-member for lifting and carrying the golf carrier.

The secondary support frame includes golf club supporting third and fourth legs, the upper ends of which are hingedly connected to the primary support frame adjacent to the interconnections of the first and second legs and the first cross-member. The lower ends of the third and fourth legs are interconnected by a third cross-member at a selected distance above their lower ends which also terminate in ground engaging tips. In this way, the third and fourth legs of the secondary support frame are pivotally movable relative to the primary support frame such that the third and fourth legs may be pivoted to a position adjacent to the first and second legs to define a closed position for storage or transport of the golf carrier, or pivoted away from the primary support frame to define an opened position resembling an inverted V when viewed from either end, with the tips of the legs stably resting on the ground. The third and fourth legs extend beyond the first and second legs such that, when in the closed position, the golf carrier can be rapidly deployed by engaging the third and fourth legs with the ground and then tilting the handle to swing the primary support frame away from the secondary support frame to the stable opened position of the golf carrier.

Golf club supporting means are located along the first, second, third and fourth legs for removably receiving golf clubs in a generally horizontal orientation, with the shaft of each club being engaged on both the first and second legs or both the third and fourth legs. Golf ball supporting means and golf tee supporting means are located along the second and third cross-members for removably receiving golf balls and golf tees, respectively.

Preferably, the golf club supporting means comprise a plurality of projections on the first, second, third and fourth legs, and a like plurality of golf club retaining spring means associated with the projections. The projections define upwardly open club retaining notches and spring mounting means for supporting the spring means within and in resilient engagement with the club retaining notches such that a golf club shaft can be inserted into and removed from a pair of the club retaining notches by deflecting two of the spring means.

Preferably, the spring mounting means comprise blades within the club supporting projections and the spring means comprise formed flat springs each including on one end a generally U-shaped retaining portion for mounting upon one of the blades. The U-shaped retaining portion of each spring includes a tab projecting into its U-shaped opening for engagement with one of the ends of a blade to retain the spring in position on the blade. The other end of each formed flat spring comprises a generally planar spring opening portion extending from the club retaining notches toward their associated legs whereby each of the spring means can be deflected to open its associated club retaining notch by engaging the spring opening portion with the shaft of a golf club. The springs thus serve not only to hold club shafts within the club retaining notches, but also to close the club retaining notches when no club is inserted therein to make the projections less apt to be caught as the golf carrier is handled.

The golf ball supporting means preferably comprise a plurality of apertures through the second and third cross-members, with the apertures defining arcuate sections sized for receiving a golf ball. Resilient segmented ball retaining arms extend on opposite sides of the apertures, with the arms terminating in inwardly extending flanges which are sized and spaced apart by a distance to permit a golf ball to be forced therebetween and thereafter engage the golf ball to hold it in one of the apertures. Golf balls may be inserted or removed by hand force applied to a ball to thereby retract or spring apart the associated ball retaining arms. The golf tee supporting means comprise hollow segmented bosses formed of a plastic material and extending beyond the second and third cross-members, with the hollows of the bosses opening on the outer surfaces of the second and third cross-members and being sized to receive gold tees whereby golf tees inserted into the hollows expand and are gripped by the segmented bosses.

To facilitate aligned closure of the primary and secondary support frames, pegs are formed on the inner sides of the first, second, third and fourth legs, with the pegs being received within the leg opposite thereto and engaging that leg to effect alignment. The pegs further serve to absorb stresses which otherwise would be transmitted and applied to the hinged connection between the primary support frame and the secondary support frame and could reduce the operable lifetime of the golf carrier.

Preferably, the primary support frame and secondary support frame including the golf club supporting projections, the alignment pegs, the golf ball supporting means and the golf tee supporting means are formed from a rigid plastic material and the golf club retaining springs are formed of a relatively more resilient plastic material whereby all major components of the golf carrier are made of rust-proof plastic materials. To make the carrier lightweight yet strong and to facilitate molding from a plastic material, the primary and secondary support frames are generally planar with rearwardly extending flanges terminating in an open-back to form a channel-like structure.

To further ease transport of the golf carrier, strap receiving slots are preferably formed into the first cross-member adjacent ends of the bridged handle section such that the gold carrier can be supported over a user's shoulder by means of a carrying strap secured to the slots. The bridged handle also is adapted to receive a scoring pencil by being formed as a central rib with an upper rounded flange, and a lower scalloped flange with pencil receiving clips formed on the rib out of the gripping area of the handle. The scallops on the lower flange of the handle afford comfortable finger receiving indentations to add to the ease and enjoyment of use.

It is a primary object of the present invention to provide a lightweight, inexpensive golf carrier device for removably retaining golf clubs, balls and tees.

Other objects and advantages of the invention will be apparent from the following description, the accompanying drawings and the appended claims.

BRIEF DESCRIPTION OF THE DRAWINGS

FIG. 14 is a broken away sectional view taken along the line 4—4 of FIG. 3 of a portion of one of the carrier legs showing one of the golf club supporting projections.

DETAILED DESCRIPTION OF THE INVENTION

Figure 1:
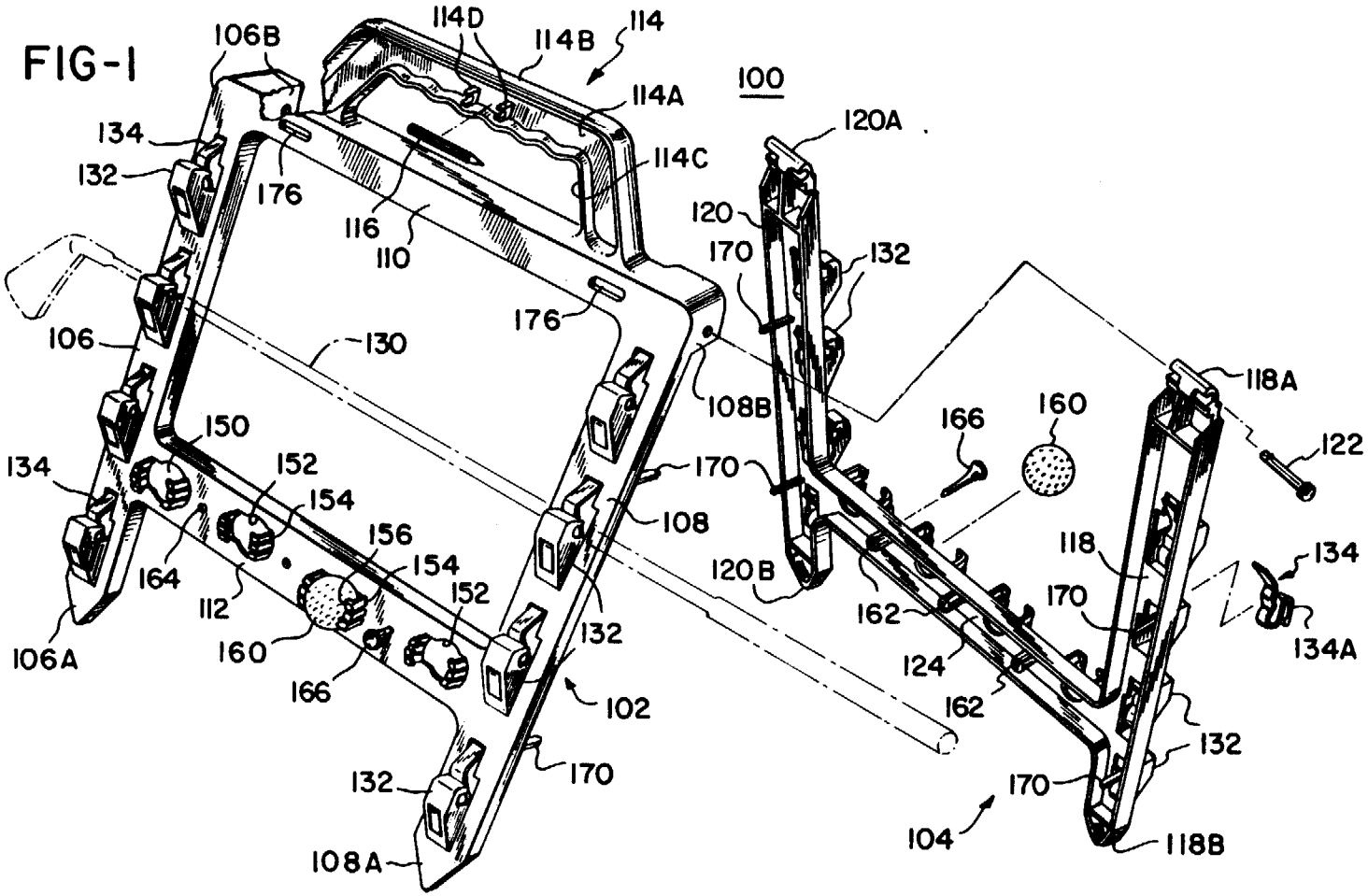
FIG. 1 is an exploded perspective view of the golf equipment carrier in accordance with the present invention shown in its stable open position.

A golf equipment carrier 100 in accordance with the present invention and providing for removably supporting a plurality of golf clubs and golfing equipment is shown in FIG. 1. The golf carrier 100 comprises a primary support frame 102 and a secondary support frame 104 which is hingedly connected to the primary support frame 102. The primary support frame 102 is an open, generally rectangular structure formed by a first golf club supporting leg 106 and a second golf club supporting leg 108 which are interconnected at their upper ends by a first cross-member 110, and at a defined distance above their lower ends by a second cross-member 112. The lower ends of the first and second legs 106 and 108 terminate in ground engaging tips 106A and 108A. The first cross-member 110 defines handle means which, in the illustrated embodiment, comprises a bridged handle 114 extending over and above the first cross-member 110 for lifting and carrying the golf carrier 100.

The bridged handle 114 is preferably formed or constructed as a central rib 114A with an upper rounded flange 114B and a lower flange 114C serving to expand and strengthen the handle 114. The central portion of the lower flange 114C is scalloped to form finger receiving indentations which facilitate comfortable gripping of the handle 114 to add to the ease and enjoyment of use of the golf equipment carrier 100. Pencil receiving clips 114D are formed on the central portion of the rib 114A of the handle 114 to receive a scoring pencil 116 at a position which is recessed relative to the edges of the flanges 114B and 114C to prevent interference with gripping the handle 114.

The secondary support frame 104 is a generally U-shaped structure formed by a third golf club receiving leg 118 and a fourth golf club receiving leg 120, the upper ends of which form hinge pin receiving barrels 118A and 120A which serve to hingedly connect the secondary support frame 104 to the primary support frame 102. Flanges 106B of the first leg 106 and flanges 108B of the second leg 108 receive the barrels 120A and 118A, respectively, and are inerconnected by means of hinge pins 122, bolts or comparable connecting devices. Thus, the upper ends of the third and fourth legs 118 and 120 are hingedly connected to the primary support frame 102 adjacent to the interconnections of the first and second legs 106 and 108 and the first cross-member 110. The lower ends of the third and fourth legs 118 and 120 are interconnected by a third cross-member 124 at a defined distance above their lower ends which also terminate in ground engaging tips 118B and 120B.

Figure 2:
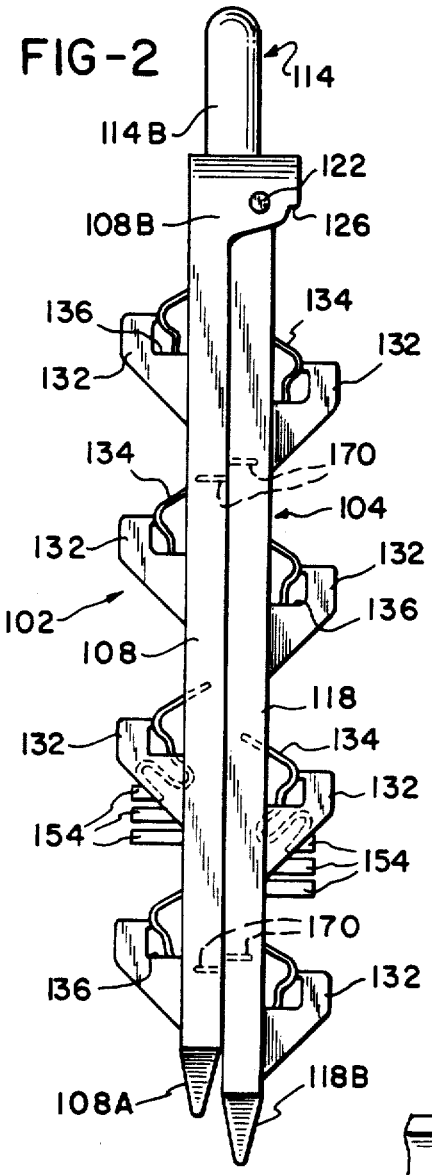
FIG. 2 is a side view of the golf equipment carrier of FIG. 1 shown in its closed position for storage or transport.

It is apparent from this construction that the secondary support frame 104 is pivotally movable relative to the primary support frame 102. The third and fourth legs 118 and 120 may be pivoted to a position adjacent to the first and second legs 106 and 108 to define a closed position as shown in FIG. 2 for storage or transport of the golf carrier 100. The closed position will be assumed by the golf carrier 100 when held by the handle 114 due to the light weight of the carrier which is supplemented by the weight of the supported golf clubs and equipment. The secondary support frame 104 may also be pivoted away from the primary support frame 102, as can be envisioned by interconnection of the parts of FIG. 1, to define an opened position resembling an inverted V when viewed from either end, with the tips of the four legs 106, 108, 118 and 120 stably resting on the ground.

Figure 3:
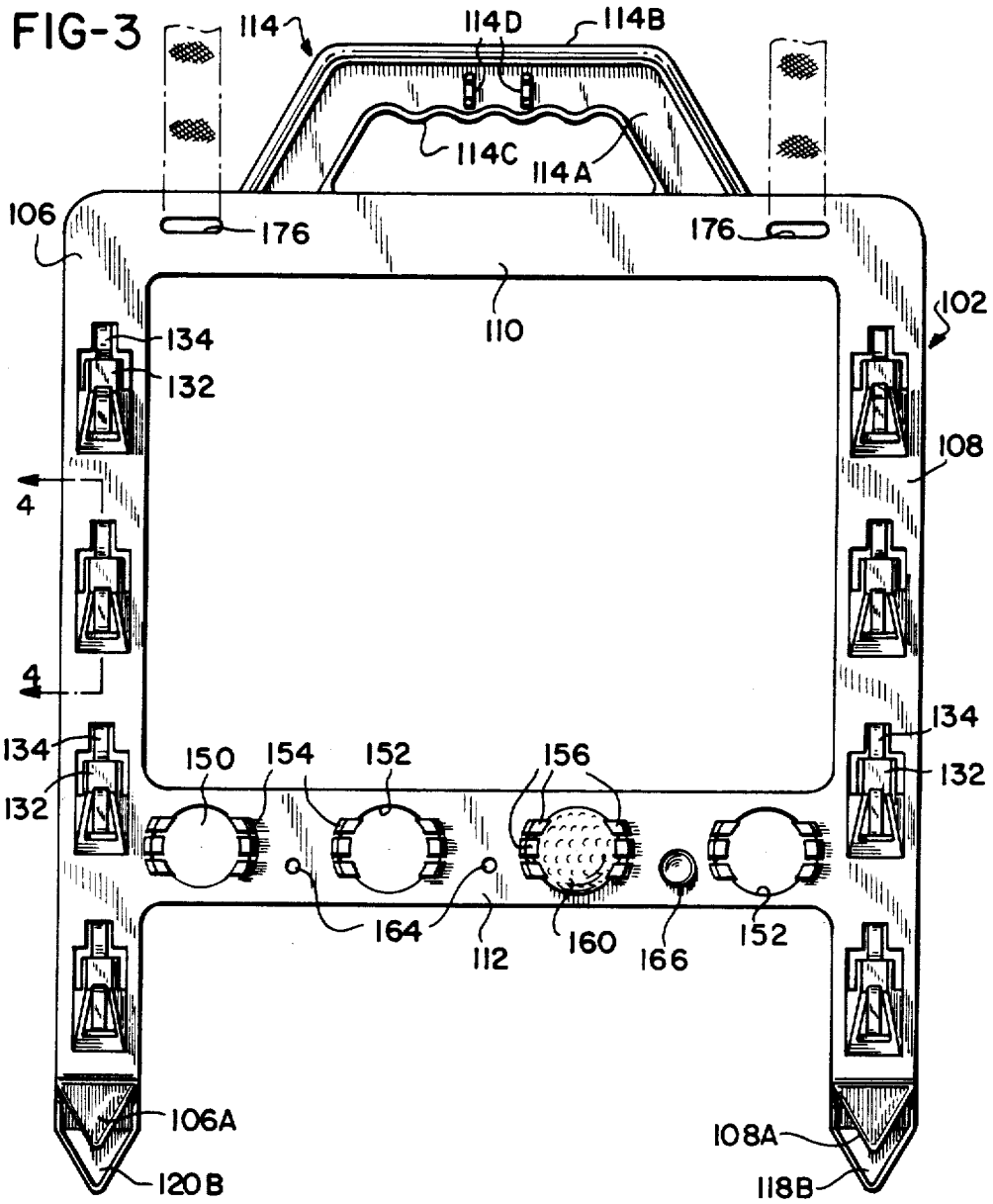
FIG. 3 is a front elevational view of the golf equipment carrier of FIG. 1 (see drawing sheet 3).

As shown in FIGS. 2 and 3, the third and fourth legs 118 and 120 extend beyond the first and second legs 106 and 108 such that the golf carrier 100 can be rapidly deployed to the opened position. To open the golf carier 100, the tips 118B and 120B of the third and fourth legs 118 and 120 are engaged with the ground and the handle 114 is tilted to swing the primary support frame 102 away from the secondary support frame 104. The handle 114 is then moved to engage the tips 106A and 108A of the first and second legs 106 and 108 with the ground. Notches 126 are formed into the upper rear portions of the first and second legs 106 and 108 to limit the outward pivotal movement of the secondary support frame 104 relative to the primary support frame 102 to thereby define the stable opened position of the golf carrier 100 in accordance with the present invention.

Golf club supporting means are located along the first, second, third and fourth legs 106, 108, 118 and 120 of the golf carrier 100 for removably receiving golf clubs in a generally horizontal orientation as shown in dash-dot lines by a club 130 in FIG. 1. The shaft of each club is engaged on both the first and second legs 106 and 108 as illustrated by the club 130, or on both the third and fourth legs 118 and 120 in a similar manner as is apparent. The golf club supporting means in the illustrative embodiment comprise a plurality of projections 132 on the first, second, third and fourth legs 106, 108, 118 and 120 and a like plurality of golf club retaining spring means which comprise formed flat springs 134 as will be fully described.

Figure 4:
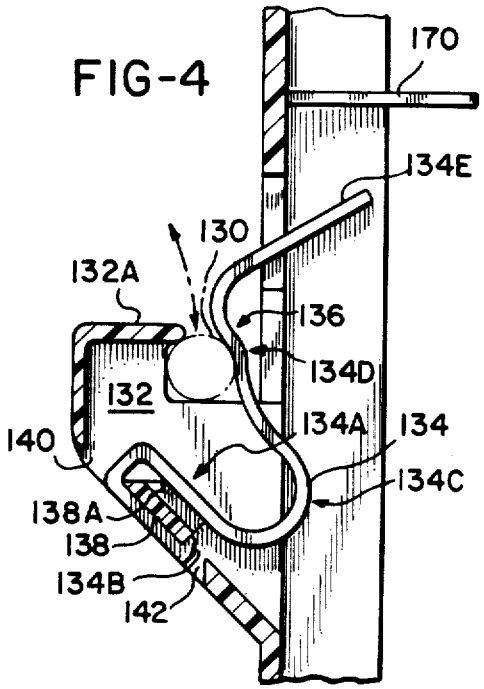

Each of the projections 132 defines an upwardly opened club retaining notch 136 as best shown in FIGS. 2 and 4. The upper surface 132A of each projection 132 extends slightly into the club retaining notch 136, which together with an associated spring 134, ensures retention of a golf club within the golf club retaining notch 136. The projections 132 also define spring mounting means for supporting the springs 134 within the projections 132, and in resilient engagement with the upper surface 132A of the projections 132 when the springs 134 are not deformed by the shaft of a golf club. The spring mounting means preferably comprises a blade 138 which is formed into a lower, inclined portion of each of the projections 132, and in the illustrative embodiment, is thickened and reinforced by ribs 138A formed along the upper surface of the blade 138. Openings 140 and 142 are formed above and below the blade 138, respectively, to permit insertion of one of the springs 134 as shown and described herein.

Each of the formed flat springs 134, as best shown in FIG. 4, includes on one end a generally U-shaped retaining portion 134A for mounting the spring onto one of the blades 138. The U-shaped retaining portion 134A of each spring 134 includes a tab 134B projecting into its open end for engagement with the lower end of a blade 138 adjacent to the opening 142 to retain the spring 134 in position on the blade 138 as shown in FIG. 4 and as described. The U-shaped retaining portion 134A of each spring 134 proceeds into a larger, generally U-shaped portion 134C which directs the spring upwardly into the club retaining notch 136 and into engagement with the upper surface 132A of the projection 132 if the spring 134 is not deflected by a golf club. The upper extension of the larger U-shaped portion 134C of each spring 134 includes an indentation or notch 134D which is spaced and sized to engage the shaft of a golf club when the club is positioned within the golf club retaining notch 136. Engagement of the notch 134D with the shaft of the club 130 is shown in FIG. 4.

The spring 134 then proceeds angularly beyond the notch 134D to define a generally planar spring opening portion 134E which extends from the upper surface 132A of the projection 132 toward the associated club supporting leg to effectively close the club receiving notch 136 while no club is positioned within the notch. The spring opening portion 134E is engaged by a club shaft to deflect the spring 134 and thereby open the club retaining notch 136 such that the golf club shaft can be inserted therein. It can thus be seen that the springs 132 serve not only to hold club shafts within the club retaining notches 136, but also to close the club retaining notches 136 when no club is inserted therein such that the projections 132 are less apt to be caught as the golf carrier 100 is handled. The closed positions of the springs 134 can best be seen in FIGS. 1 and 2. A club is removed from a receiving pair of the club retaining notches 136 by applying pressure to the club and thereby deflecting the pair of associated springs 134.

Figure 5:
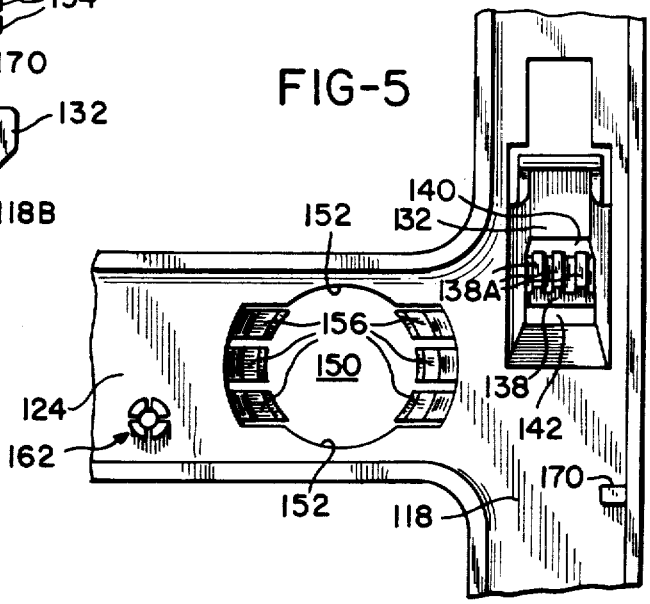
FIG. 5 is a broken away rear view of the inner section of one of the club supporting legs and one of the ball and tee supporting cross-members.

Golf ball supporting means and golf tee supporting means are located along the second and third cross-members 112 and 124 and serve to removably receive golf balls and golf tees, respectively. In the illustrative embodiment, the golf ball supporting means comprise a plurality of apertures 150 through the second and third cross-members 112 and 124, with the apertures defining arcuate sections 152 sized to receive golf balls, as best shown in FIG. 5. Resilient segmented ball retaining arms 154 extend outwardly from the cross-members 112 and 124 adjacent to and on opposite sides of the apertures 150. The arms 154 terminate in inwardly extending flanges 156 which are sized and spaced apart by a sufficient distance to permit a golf ball to be forced therebetween, yet thereafter to spring back and engage the outer portions of the golf ball to hold it in one of the apertures 150. A golf ball 160 may be inserted or removed by hand force applied to the ball 160 to thereby retract or spring apart the associated ball retaining arms 154 to permit the ball 160 to pass beyond the inwardly extending flanges 156.

The golf tee supporting means in the illustrative embodiment of the golf equipment carrier 100 comprise hollow segmented bosses 162 formed of a plastic material and extending beyond the second and third cross-members 112 and 124. The hollow openings 164 of the segmented bosses 162 open on the outer surfaces of the second and third cross-members 112 and 124 and are sized to receive a golf tee 166 such that a golf tee 166 inserted into the hollow opening 164 of a segmented boss 162 expands and is gripped by the segments of the boss 162.

To facilitate aligned closure of the primary support frame 102 and the secondary support frame 104, pegs 170 are formed on the inner sides of the first, second, third and fourth legs 106, 108, 118 and 120, with the pegs being received within the leg opposite thereto and engaging that leg to effect alignment. The pegs 170 further serve to absorb stresses which otherwise would be transmitted and applied to the hinged connection between the primary support frame 102 and the secondary support frame 104. The pegs 170 in absorbing these stresses and thereby limiting the stresses applied to the hinges serve to extend the operable lifetime of the golf carrier 100.

Preferably, and in accordance with the illustrative embodiment, the primary support frame 102 and secondary support frame 104 including the golf club supporting projections 132, the alignment pegs 170, the golf ball supporting means and golf tee supporting means are formed from a rigid plastic material and the golf club retaining springs 134 are formed of a relatively more resilient plastic material such that all major components of the golf carrier 100 in accordance with the present invention are made of rustproof plastic materials to thereby extend the life of the carrier.

In accordance with the formation of the golf carrier 100 from rigid plastic material and to make the carrier lighweight yet strong, the primary and secondary support frames 102 and 104 comprise generally planar facing surfaces with rearwardly extending flanges terminating in an open-back to form a channel-like structure as best shown in FIGS. 1, 4 and 5. Such formation of the primary and secondary support frames 102 and 104 also facilitates formation of the carrier by means of plastic molding. To additionally ease transport of the golf carrier 100, strap receiving slots 176 are preferably formed into the first cross-member 110, adjacent ends of the bridged handle 114, such that the golf carrier 100 can be supported over a user's shoulder by means of a carrying strap secured to the slots 176.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A golf carrier for removably supporting a plurality of golf clubs and associated golfing equipment comprising:

a primary support frame including golf club supporting first and second legs which are interconnected at their upper ends by a first cross-member and at a defined distance above their lower ends by a second cross-member, the lower ends of said first and second legs which extend beyond said second cross-member terminating in ground engaging tips and said first cross-member defining handle means for lifting and carrying said golf carrier;

a secondary support frame including golf club supporting third and fourth legs, the upper ends of which are hingedly connected to said primary support frame adjacent to the interconnections of said first and second legs and said first cross-member, the lower ends of said third and fourth legs being interconnected by a third cross-member at a selected distance above their lower ends which terminate in ground engaging tips, said secondary support frame being pivotally movable relative to said primary support frame between a closed position adjacent to said primary support frame and an opened position separated therefrom, said third and fourth legs extending beyond said first and second legs when in said closed position whereby said golf carrier can be rapidly deployed by engaging said third and fourth legs with the ground and then tilting the handle to swing the primary support frame away from the secondary support frame to a stable opened ground support position for the golf carrier;

golf club supporting means located along said first, second, third and fourth legs for removably receiving golf clubs in a generally horizontal orientation with the shaft of each club being engaged on both the first and second legs or both the third and fourth legs;

golf ball supporting means located along said second and third cross-members for removably receiving golf balls therein; and golf tee supporting means located along said second and third cross-members for removably receiving golf tees therein.

2. A golf carrier as claimed in claim 1 wherein said golf club supporting means comprise a plurality of club retaining spring means and a like plurality of projections on said first, second, third and fourth legs, said projections defining upwardly open club retaining notches and spring mounting means for supporting said spring means within and in resilient engagement with said club retaining notches whereby a golf club shaft can be inserted into and removed from a pair of said club retaining notches by deflecting two of said spring means supported upon the associated spring mounting means, said spring means serving to retain golf club shafts when fully inserted into said club retaining notches.

3. A golf carrier as claimed in claim 2 wherein said spring mounting means comprise blades within said projections and said spring means comprise formed flat springs including on one end generally U-shaped retaining ends for mounting upon said blades, said U-shaped retaining ends including tabs projecting into the open end of the U-shaped openings of said retaining ends for engagement with one of the ends of said blades to retain said flat springs in position on said blades, and on the other end, a generally planar spring opening portion extending from the club retaining notches toward their associated legs whereby each of said spring means can be deflected by engagement of said spring opening portion with the shaft of a golf club.

4. A golf carrier as claimed in claim 3 wherein said golf ball supporting means comprise a plurality of apertures through said second and third cross members defining arcuate sections sized for receiving a golf ball and resilient segmented ball retaining arms extending on opposite sides of said apertures, said arms terminating in inwardly extending flanges which are sized and spaced apart by a distance to permit a golf ball to be forced therebetween and thereafter engage outer portions of said golf ball to hold it in one of said apertures yet permit removal of said golf ball by hand force against said ball to thereby retract or spring said arms apart.

5. A golf carrier as claimed in claim 4 wherein said golf tee supporting means comprise hollow, segmented bosses formed of a plastic material and extending beyond said second and third cross-members, with the hollows of said bosses opening on the outer surfaces of said second and third cross-members and being sized to receive golf tees whereby golf tees inserted into said hollows expand and are gripped by said segmented bosses.

6. A golf carrier as claimed in claim 4 wherein said handle means comprises a bridged section extending over and above said first cross-member and defining a plurality of scallops toward said first cross-member for comfortable gripping of said handle, said bridged section conprising a central rib with flanges on both sides with scoring pencil retaining clips positioned on said central rib whereby a scoring pencil can be supported within said handle means without interferring with the carrying comfort of the user of said golf carrier.

7. A golf carrier as claimed in claim 6 further comprising strap receiving slots formed into said first cross-member adjacent the ends of said bridged section for receiving a shoulder carrying strap whereby said golf carrier can be carried over a user's shoulder by a carrying strap secured to said strap receiving slots.

8. A golf carrier as claimed in claim 6 further comprising pegs formed on the inner faces of said first, second, third and fourth legs for aligning said legs when said carrier is moved to said closed position, said pegs being received within the leg opposite thereto and engaging said leg to effect alignment, said projection further serving to absorb stresses which could otherwise be transmitted and applied to the hinged connection between said primary support frame and said secondary support frame.

9. A golf carrier as claimed in claim 8 wherein said primary support frame and secondary support frame including said golf club supporting projections, said alignment pegs, said golf ball supporting means and said golf tee supporting means are formed from a rigid plastic material and said golf club retaining springs are formed of a relatively resilient plastic material whereby all major components of said golf carrier are made of rust-proof plastic materials.

10. A golf carrier as claimed in claim 9 wherein said primary support frame and said secondary support frame are formed as a generally planar face with rearwardly extending flanges surrounding the edges thereof and terminating in an open-back to form a channel-like structure whereby said carrier is lightweight yet strong and may be readily molded from a relatively rigid plastic material.

* * * * *